US005526008A

United States Patent [19]

Meserole et al.

[11] Patent Number: 5,526,008

[45] Date of Patent: Jun. 11, 1996

[54] ANTENNA MIRROR SCANNOR WITH CONSTANT POLARIZATION CHARACTERISTICS

[75] Inventors: William E. Meserole, Boynton, Fla.; Paul Heller, Dix Hills; Gerald M. Kaniscak, Hadley, both of N.Y.

[73] Assignee: AIL Systems, Inc., Deer Park, N.Y.

[21] Appl. No.: 345,230

[22] Filed: Nov. 28, 1994

Related U.S. Application Data

[63] Continuation of Ser. No. 81,581, Jun. 23, 1993, abandoned.

[51] Int. Cl.[6] ..... H01Q 19/10

[52] U.S. Cl. ..... 343/761; 343/705; 343/837; 343/839

[58] Field of Search ..... 343/761, 837, 343/839, 840, 781 P, 705; H01Q 19/10, 1/28

[56] References Cited

U.S. PATENT DOCUMENTS

| | | | |
|---|---|---|---|
| 2,414,103 | 1/1947 | Hunter | 343/840 |
| 2,595,271 | 5/1952 | Kline | 343/761 |
| 2,834,014 | 5/1958 | Thorne | 343/705 X |
| 3,096,515 | 7/1963 | McLeod | 343/705 X |
| 3,473,162 | 10/1969 | Veith . | |
| 3,535,543 | 10/1970 | Dailey | 343/705 X |
| 3,611,394 | 10/1971 | Parker | 343/761 |
| 3,708,795 | 1/1973 | Lyons | 343/837 X |
| 3,793,637 | 2/1974 | Meek | 343/837 X |
| 3,795,003 | 2/1974 | Meek et al. | 343/837 X |
| 3,795,004 | 2/1974 | Meek et al. | 343/837 X |
| 3,848,255 | 11/1974 | Migdal | 343/761 |
| 3,916,416 | 10/1975 | Lewis | 340/840 X |
| 3,953,857 | 4/1976 | Jenks | 343/705 |
| 4,504,835 | 3/1985 | Howard et al. | 343/761 X |
| 4,920,350 | 4/1990 | McGuire et al. | 343/840 X |

FOREIGN PATENT DOCUMENTS

| | | | |
|---|---|---|---|
| 3237484A1 | 4/1984 | Germany | H01Q 3/20 |
| 3540808 | 5/1987 | Germany | H01Q 1/28 |
| 3928926 | 4/1991 | Germany | H01Q 1/28 |
| 3189582 | 8/1991 | Japan | G01S 13/87 |

OTHER PUBLICATIONS

Glazman et al, "A Fixed Radiotelescope for the Millimeter Range of Wavelengths," (May 1971) Radiophysics & Quantum Electron., vol. 14, No. 5, pp. 523–530.

Romann, et al., "Environmental Exploration Based on a Three–Dimensional Imaging Radar Sensor", *Proceedings of the 1992 IEEE/RSJ International Conference on Intelligent Robots and Systems,* Raleigh, Inc. USA, vol. 1, pp. 422–429, Figure 1–3, Jul. 1992.

*Primary Examiner*—Donald T. Hajec
*Assistant Examiner*—Steven Wigmure
*Attorney, Agent, or Firm*—Hoffmann & Baron

[57] ABSTRACT

An antenna mirror scanner for generating and directing an antenna scanner beam displaying constant polarization vectors. The antenna mirror scanner includes a non-rotating fixed-aperture antenna for transmitting and receiving an electromagnetic plane wave in a form of an antenna scanner beam and a planar reflector with a reflective planar surface. A rotational axis of the planar reflector is aligned orthogonally to a direction of propagation of the antenna scanner beam propagating towards or away from the reflective surface. A motor rotates the planar reflector to direct the antenna scanner beam incident on the reflective surface either into the non-rotating fixed-aperture antenna when the antenna mirror scanner is operating in a receive mode or from the non-rotating fixed-aperture antenna when the antenna mirror scanner is operating in the transmit mode.

10 Claims, 9 Drawing Sheets

ANTENNA MIRROR SCANNOR WITH CONSTANT POLARIZATION CHARACTERISTICS

This is a continuation of copending application Ser. No. 08/081,581 filed on Jun. 23, 1993, now abandoned.

BACKGROUND OF THE INVENTION

1. Field of the Invention

The invention relates to an antenna mirror scanner method and apparatus, and more particularly relates to an antenna mirror scanner method and apparatus for use in remote earth radiometric sensors.

2. Description of the Prior Art

A conventional method for generating conically scanned narrow antenna beams includes feeding or exciting a rotating tilted planar reflector, i.e., a splash plate, with a non-rotating direct-aperture source, such as a horn or a parabolic feed antenna. The axis of symmetry of the non-rotating direct-aperture antenna is aligned with a spin axis of the planar reflector. The rotation of the tilted planar reflector about its spin axis directs the resulting antenna beam in a narrow planar or conical scan. When the tilt angle of the tilted planar reflector is 45°, that is, when the plane of the planar reflector is tilted with respect to the spin axis, a planar (i.e., crosstrack) scan is achieved. When the tilt angle is at an angle other than 45°, a conical scan is produced.

Radiometers detect and measure radiant electromagnetic radiation. Conventional high spatial resolution radiometers typically employ narrow planar or conically scanned antenna beams such as those described previously for remote earth sensing of thermal noise emissions. A planar reflector included within the radiometer may be excited by radiant energy, i.e., thermal noise emissions, incident upon a reflective planar surface of the rotating planar reflector. The radiant energy is detected and measured from a portion of the earth tracked by a directed scan of the antenna mirror scanner.

One example of a conventional antenna mirror scanner utilizing a rotating planar reflector is NASA's advanced microwave precipitation radiometer 2 shown in FIG. 1. The advanced microwave precipitation radiometer 2 functions as a remote earth radiometric sensor, including a planar reflector 4 which rotates about a spin axis 10. Thermal emission radiation incident upon reflective surfaces 9 and 11 of planar reflector 4 is directed through either of horn focusing lenses 5 and 7 to non-rotating direct-aperture antennas 6 and 8, respectively. A pressure lid 12 encloses encoder and scanner control electronics 14 and a calibration load section 16. The spin axis 10 of the rotating planar reflector 4 is aligned with each axis of symmetry of the non-rotating direct-aperture antennas 6 and 8.

The symmetrical axes of non-rotating direct-aperture antennas 6 and 8 are positioned such that they are parallel to the spin axis of the planar reflector 4. Because of the parallel alignment of the axes, the advanced microwave precipitation radiometer 2 rotates the polarization vectors, i.e., the resultant electric and magnetic fields of the detected radiation, as the planar reflector 4 rotates about its spin axis 10 to direct the detected radiation to non-rotating direct-aperture antennas 6 and 8.

The rotation of the polarization vectors of the antenna scanner beam using the conventional mirror scanner methods such as that described above is a major disadvantage. For example, a satellite-borne radiometer scanning the earth to detect thermal noise emissions using the conventional mirror scanner method will require extensive and complex processing interpretation of the thermal noise radiation data when the antenna polarization vectors rotate as a function of a locus of the scan.

OBJECTS AND SUMMARY OF THE INVENTION

It is therefore an object of the present invention to provide an antenna mirror scanner method and apparatus for producing an antenna scanner beam in which the polarization rotation effect inherent in scanner beams produced with conventional antenna mirror scanners is eliminated.

It is another object of the present invention to provide an antenna mirror scanner method and apparatus which produces an antenna scanner beam in which the polarization vectors display an orientation that is independent of the scan angle variation.

It is still another object of the present invention to provide an antenna mirror scanner method and apparatus for producing an antenna scanner beam which displays a fixed polarization and achieves greater sensitivity and resolving power than scanner beams provided by conventional antenna mirror scanners.

It is a further object of the present invention to provide a remote earth radiometric sensor employing an antenna mirror scanner which produces the same earth scan as conventional radiometric sensors but without any polarization rotation of the antenna scanner beam.

A method in accordance with one embodiment of the invention includes the step of aligning a reflector having at least one reflective surface with a non-rotating fixed-aperture antenna so that a direction of propagation of a plane wave of electromagnetic energy radiated either towards or away from the antenna is orthogonal rather than parallel to a rotational axis of the reflector. The method also includes the step of rotating the reflector about the rotational axis to direct the plane wave as an antenna scanner beam incident upon the at least one reflective surface either towards or away from the non-rotating fixed-aperture antenna.

The invention also includes a remote earth radiometric sensor having at least one non-rotating fixed-aperture receiving antenna and at least one planar reflector with at least one reflective planar surface. An axis of rotation of the at least one planar reflector being positioned orthogonal to an axis of symmetry of the at least one non-rotating direct-aperture antenna. Rotation means, such as a motor, rotates the planar reflector to direct an antenna scanner beam displaying constant polarization characteristics resulting from thermal noise generated electromagnetic energy. The thermal noise generated electromagnetic energy is radiated from the earth in the form of a plane wave and is incident as an antenna scanner beam upon the at least one reflective planar surface where it is directed to the at least one non-rotating direct-aperture antenna.

These and other objects, features and advantages of this invention will be apparent from the following detailed description of illustrative embodiments thereof, which is to read in conjunction with the accompanying drawings.

DETAILED DESCRIPTION OF THE PREFERRED EMBODIMENTS

Figure 2A:
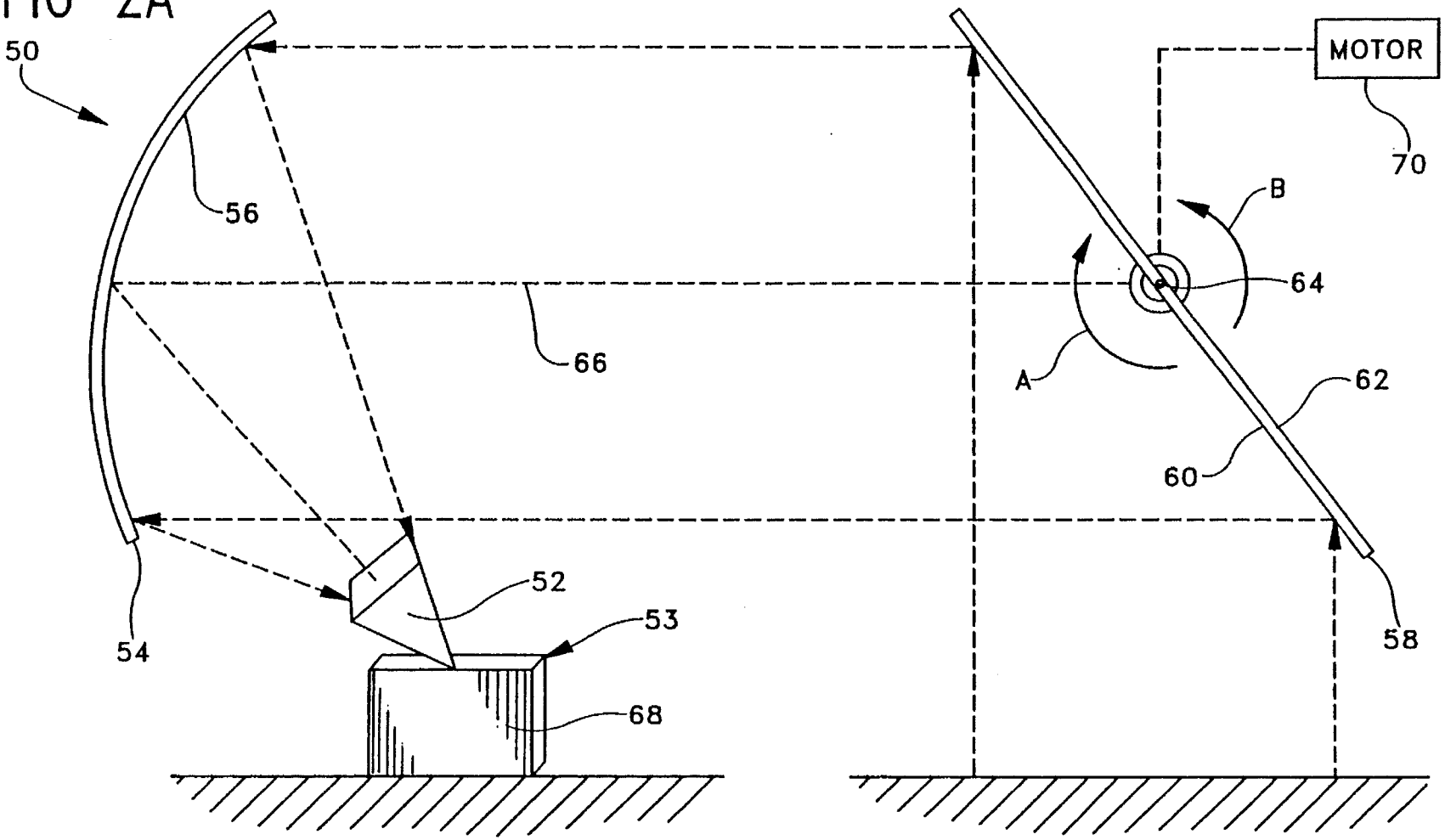
FIG. 2A is a side view of one embodiment of an antenna mirror scanner of the present invention.

An antenna mirror scanner 50 of the present invention is shown in FIG. 2A. The antenna mirror scanner 50 includes a non-rotating horn 52 mounted upon a support structure 68. The non-rotating horn 52 is positioned at the focus of a paraboloid 54. A reflective surface 56 of the paraboloid 54 directively reflects and collimates electromagnetic energy incident upon it.

The antenna mirror scanner 50 also includes a planar reflector 58 having opposite first and second reflective planar surfaces 60 and 62. Planar reflector 58 rotates about a rotational axis 64, as illustrated by arrows A and/or B, thereby reflectively directing electromagnetic energy incident in the form of a plane wave upon the reflective planar surfaces 60 and 62 of reflector 58. A motor 70 is mechanically connected to the planar reflector 58 to rotate it about rotational axis 64.

In one embodiment of the invention, the antenna mirror scanner 50 is utilized as a remote earth radiometric sensor, i.e., operating in a passive or receiving mode. During passive operation, an antenna scanner beam comprising thermal noise radiation emitted from an earth mass being scanned is received incident on reflective planar surfaces 60 and 62 as planar reflector 58 is rotated to implement the scan. The incident antenna scanner beam is directed by either reflective planar surface towards paraboloid 54. Reflective surface 56 of paraboloid 54 acts as a non-rotating fixed-aperture antenna and further directs the antenna scanner beam into non-rotating horn 52. Data processing can then be performed on thermal information extracted from the received antenna scanner beam.

The paraboloid 54 is positioned such that a direction of propagation 66 of a plane wave propagating towards it from planar reflector 58 is always orthogonal to the rotational axis of paraboloid 54, i.e., a feed direction between paraboloid 54 and planar reflector 58. Accordingly, there is no rotation of the polarization vectors of the antenna scanner beam as the planar reflector 58 is rotated about its rotational axis 64 as is found in prior art antenna mirror scanner methods.

The antenna mirror scanner 50 of the present embodiment may also be utilized as an active scanner, i.e., operating in a transmit mode. During active operation in the transmit mode, electromagnetic energy is emitted from the antenna mirror scanner 50 in the form of an antenna scanner beam to scan a particular area of the earth. Non-rotating horn 52 radiates the electromagnetic energy towards paraboloid 54. The paraboloid 54 acts as an antenna, redirecting the electromagnetic energy in the form of an antenna scanner beam, i.e., a plane wave, from reflective surface 56 towards planar reflector 58. Reflective planar surfaces 60 and 62 of planar reflector 58 receive the antenna scanner beam and direct the beam to the area to be scanned by rotation of planar reflector 58 about its rotational axis 64.

The paraboloid 54 is positioned such that it acts as a non-rotating fixed-aperture antenna. A propagational direction 66 of the antenna scanner beam directed by reflective surface 56 is always orthogonal to the rotational axis 64 of planar reflector 58. Because of the orthogonality of the propagational direction 66 relative to rotational axis 64, there is no rotation of the polarization vectors of the antenna scanner beam.

The constant vector polarization displayed by the antenna mirror scanner 50 of the present invention is in contrast to conventional antenna mirror scanners. A symmetrical axis of a source/sink antenna within a conventional scanner is positioned substantially parallel to a spin axis of its planar reflector. While a tilt angle of the conventional antenna mirror scanner is fixed, the planar reflector rotates about its spin axis to generate a scan. The polarization vectors of the resulting antenna scanner beams vary with radial movement of the planar reflector about the spin axis.

The antenna mirror scanner of the present invention, on the other hand, orthogonally positions the rotational axis 64 of the scanner's planar reflector 58 relative to the propagational direction 66 of the plane wave, i.e., scanner antenna beam, propagating from or reflected towards paraboloid 54. This is irrespective of whether the antenna mirror scanner operates to receive or reflect the antenna scanner beam. Such an arrangement assures that the polarization orientation of the antenna scanner beam directed by planar reflector 58 is constant.

Figure 2B:
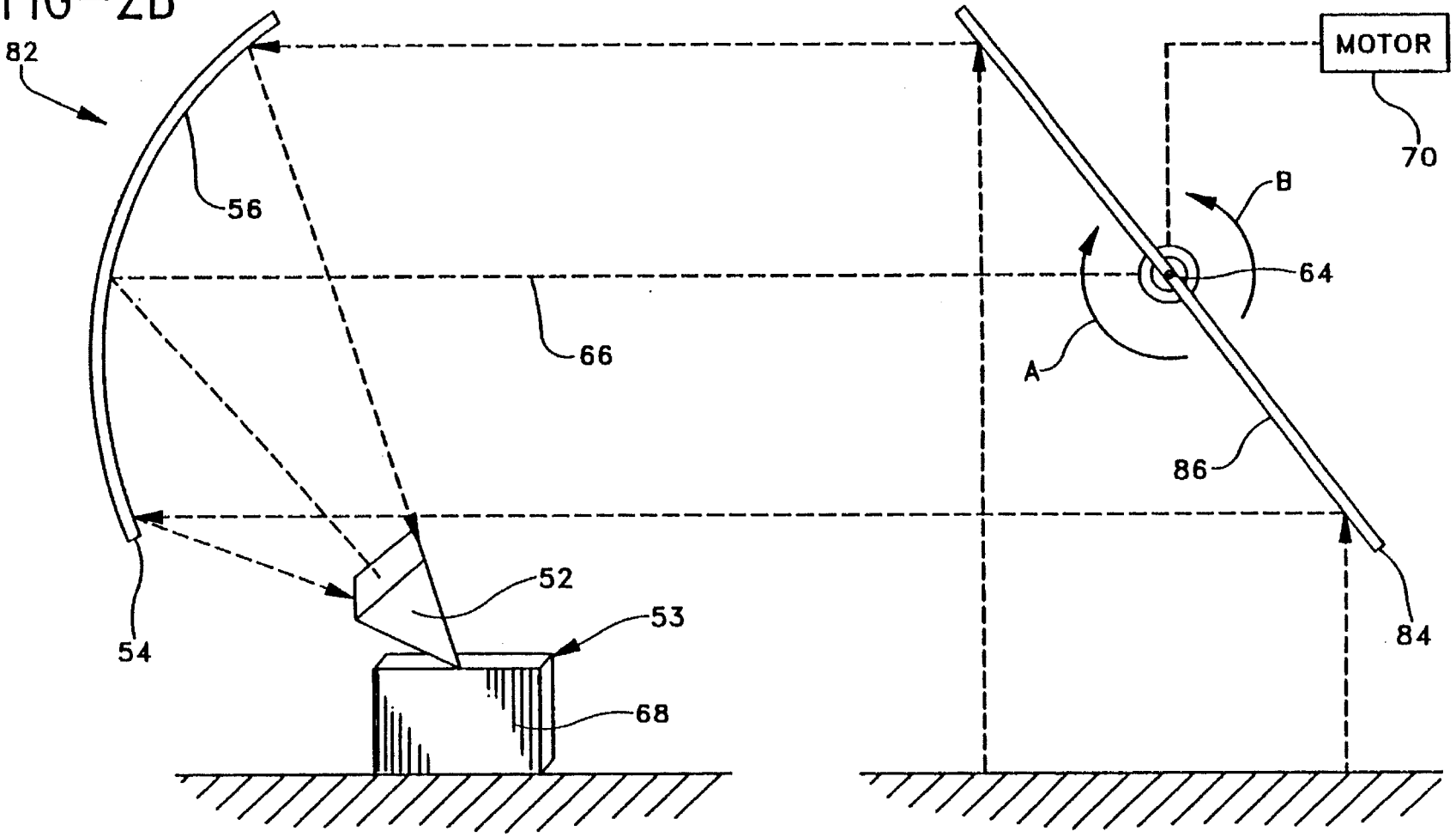
FIG. 2B is a side view of another embodiment of an antenna mirror scanner of the present invention.

FIG. 2B shows another embodiment of an antenna mirror scanner 82 of the present invention. Antenna mirror scanner 82 is similar to the antenna mirror scanner depicted in FIG. 2A except with regard to a change embodied within planar reflector 84. Planar reflector 84 includes only one reflective surface 86. Planar reflector 84 rotates about its rotational axis 88 in either rotational direction A or B. However, unlike the embodiment depicted in FIG. 2A, planar reflector 84 of the present embodiment can only provide one sweep of an antenna scanner beam for each complete rotation of the planar reflector about its rotational axis 88. The planar reflector 84 may, however, be rotated back and forth in an oscillatory motion about its rotational axis for some portion of a possible total rotational displacement of 180 degrees.

Figure 2C:
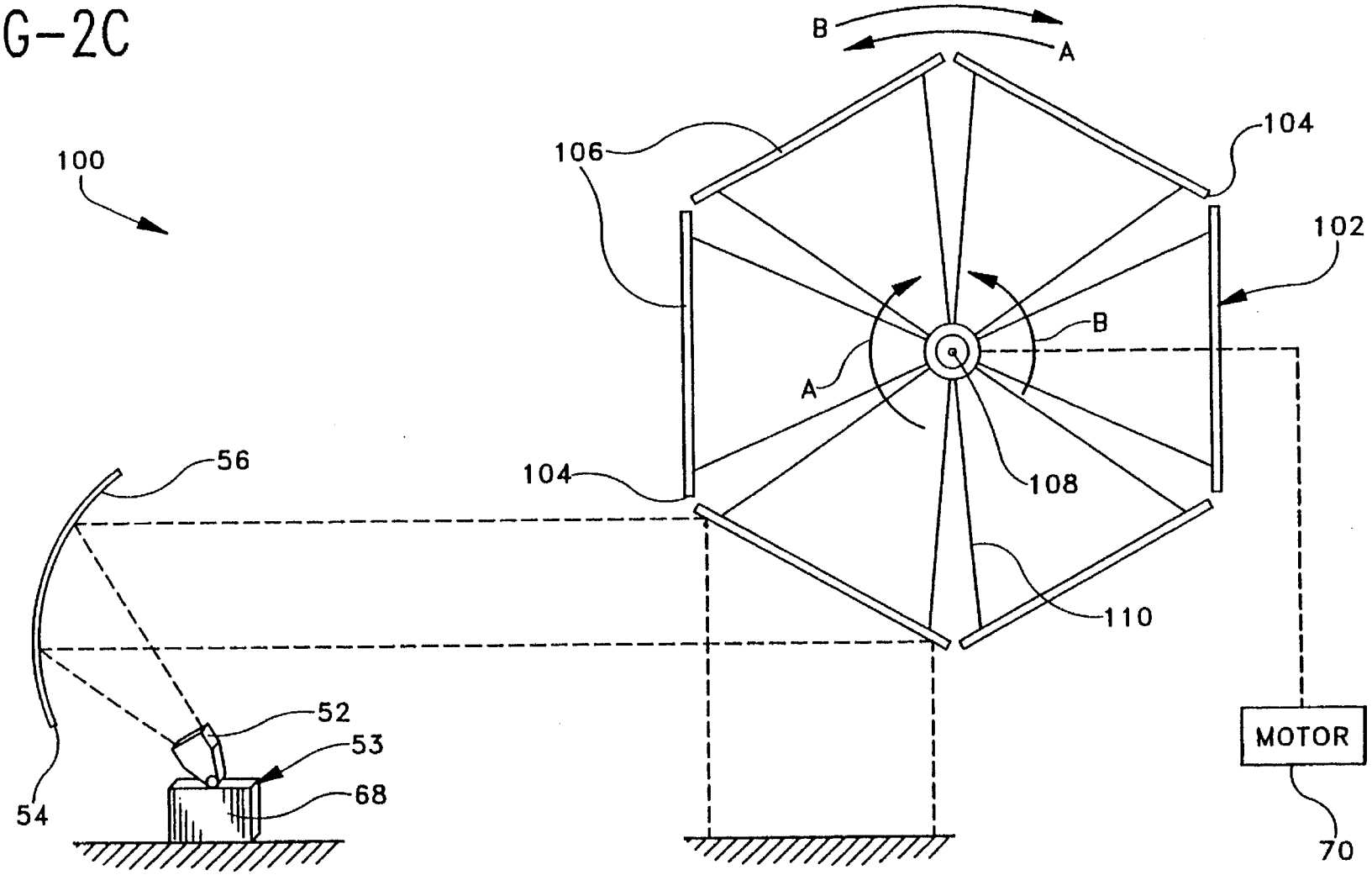
FIG. 2C is a side view of yet another embodiment of an antenna mirror scanner of the present invention.

FIG. 2C shows still another embodiment of an antenna mirror scanner 100 of the present invention. Antenna mirror scanner 100 differs from the antenna mirror scanners depicted in FIGS. 2A and 2B in that it includes a planar reflector apparatus 102 in lieu of planar reflectors 58 and 84, respectively.

Planar reflector apparatus 102 includes 6 planar reflectors 104, each having one reflective surface 106. The six planar reflectors 104 are mounted about a rotating axis 108 by strut members 110. Rotating axis 108 is mechanically connected to a motor 70 for rotating of the planar reflector apparatus 102 about the rotating axis 108. The 6 planar reflectors 104 define planar reflector apparatus 102 in a hexagonal shape.

Figure 1:
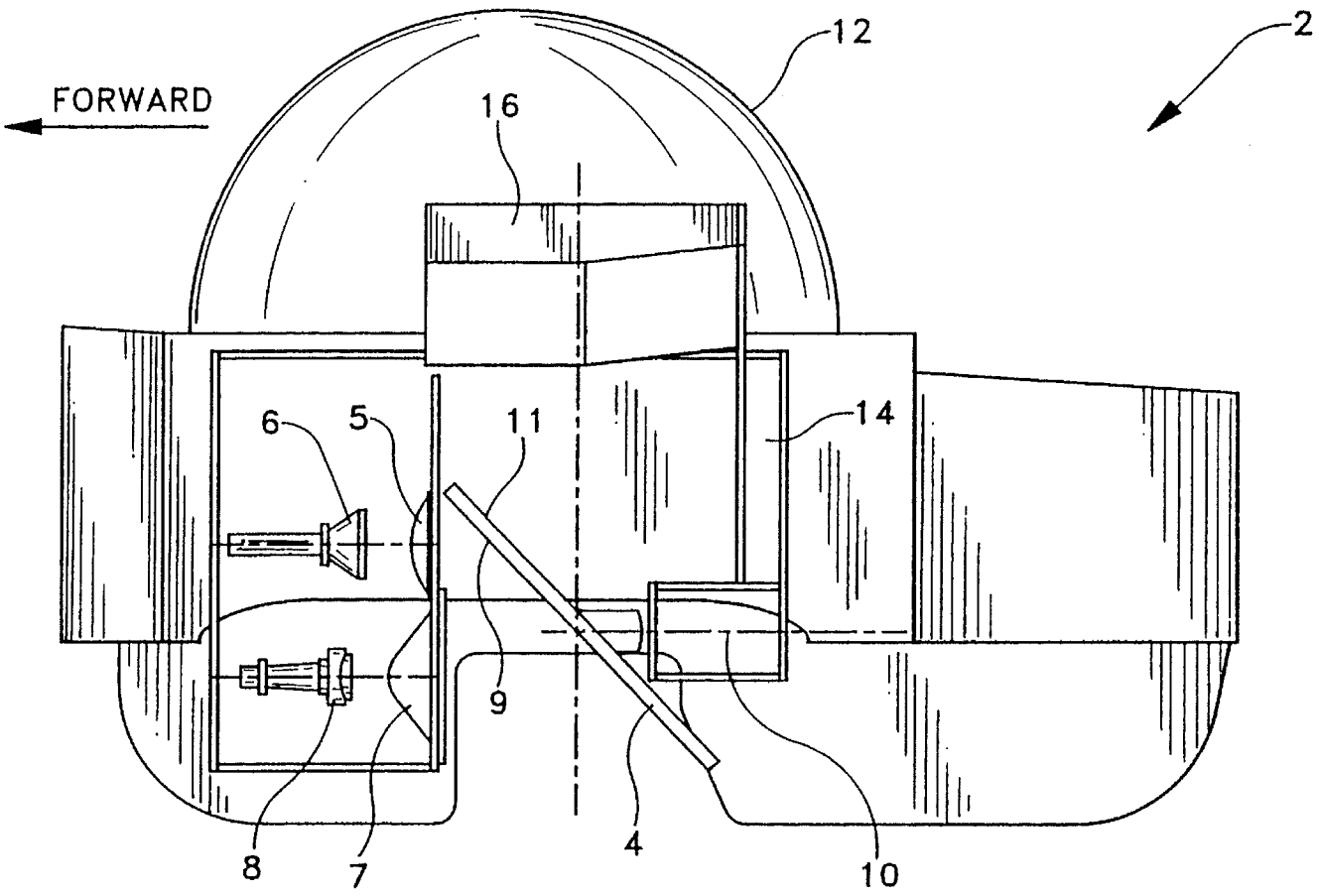
FIG—1 PRIOR ART
FIG. 1 is a side view of an advanced microwave precipitation radiometer employing a conventional mirror scanner method.
Figure 4:
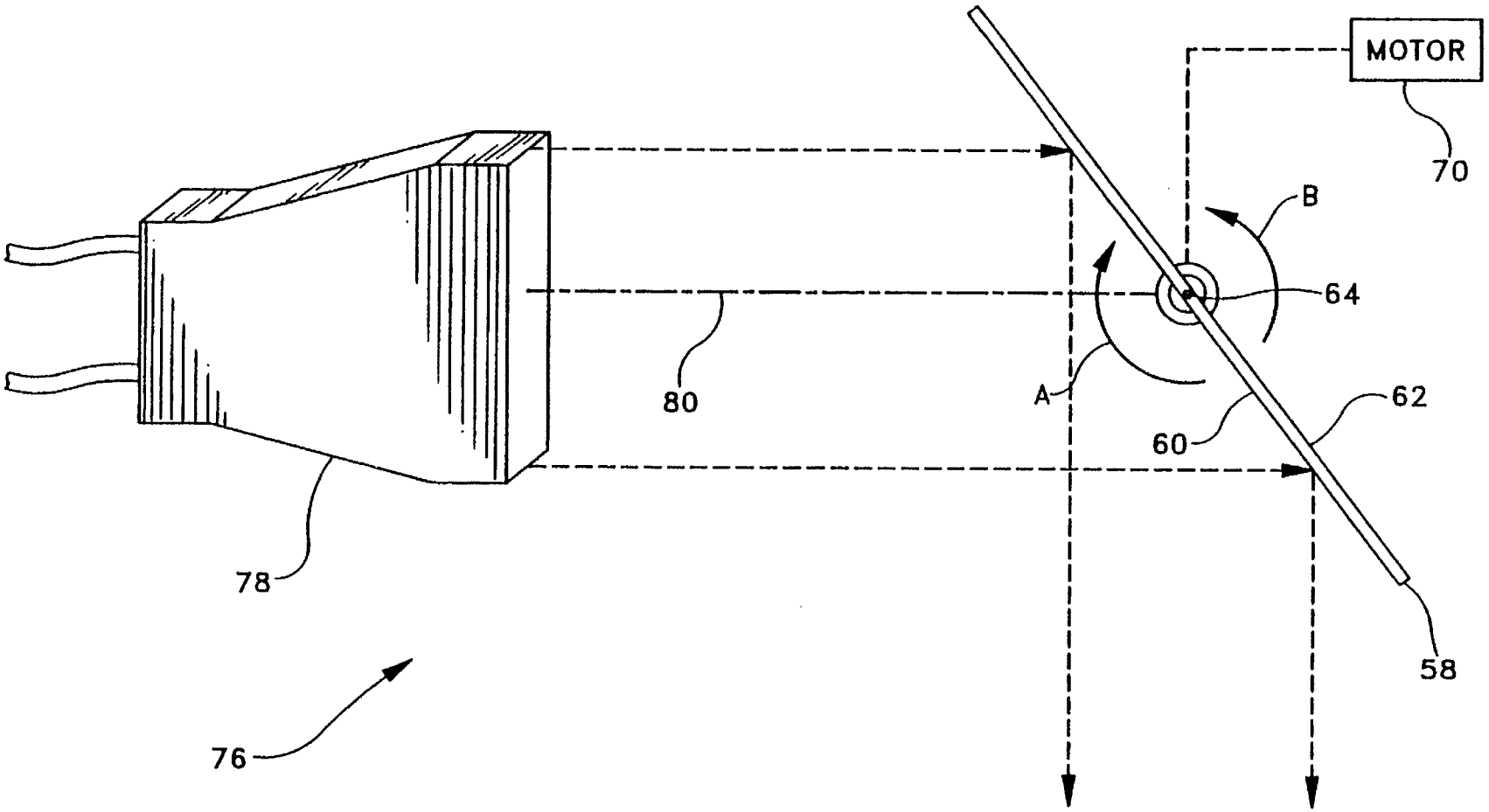
FIG. 4 is a side view of a variation of the embodiment of the present invention depicted in FIG. 2A.

As the planar reflector apparatus 102 rotates about its rotating axis 108, each planar reflector 104 directs of an antenna scanner beam either towards or away from a non-rotating fixed-aperture antenna 53. Antenna 53 may be any non-rotating fixed-aperture antenna known to those skilled in the art. For example, antenna 53 may embody a non-rotating horn 78 as depicted in FIG. 4, a horn lens such as focusing horn lens 5 shown in FIG. 1 or a combination of non-rotating horn 52 and paraboloid 54 as shown in FIGS. 2A and 2B may be used. The antenna scanner beam may be generated and directed from the antenna 53 towards each planar reflector 104 of planar reflector apparatus 102 during scanner operation in a transmit mode. The antenna scanner beam may also be generated by an earth scan and received at each planar reflector 104 of planar reflector apparatus 102 during scanner operation in a receive mode.

Figure 3A:
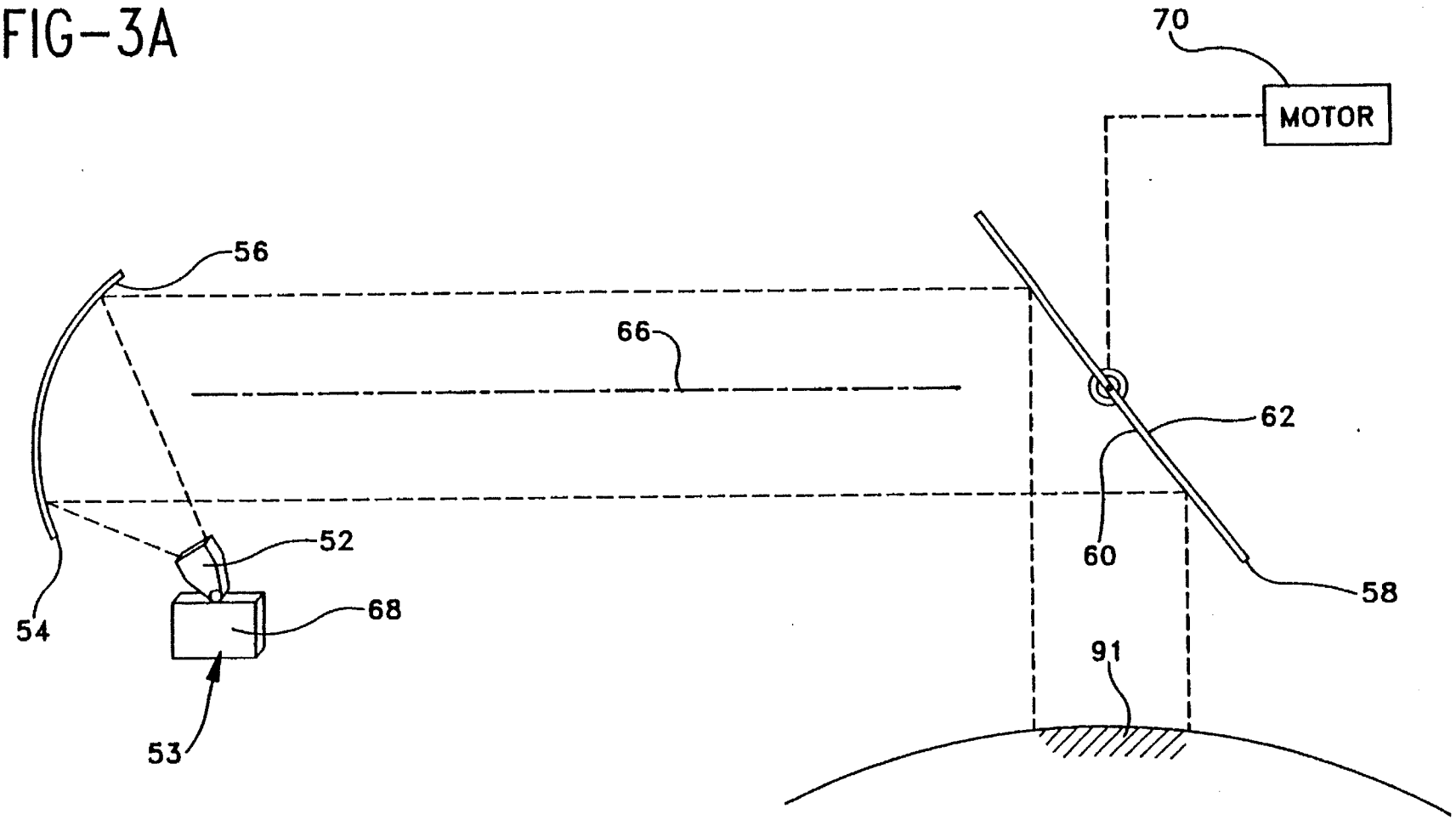
FIG. 3A is a side view of the embodiment depicted in FIG. 2A showing an antenna scanner beam footprint on the earth's surface.
Figure 3B:
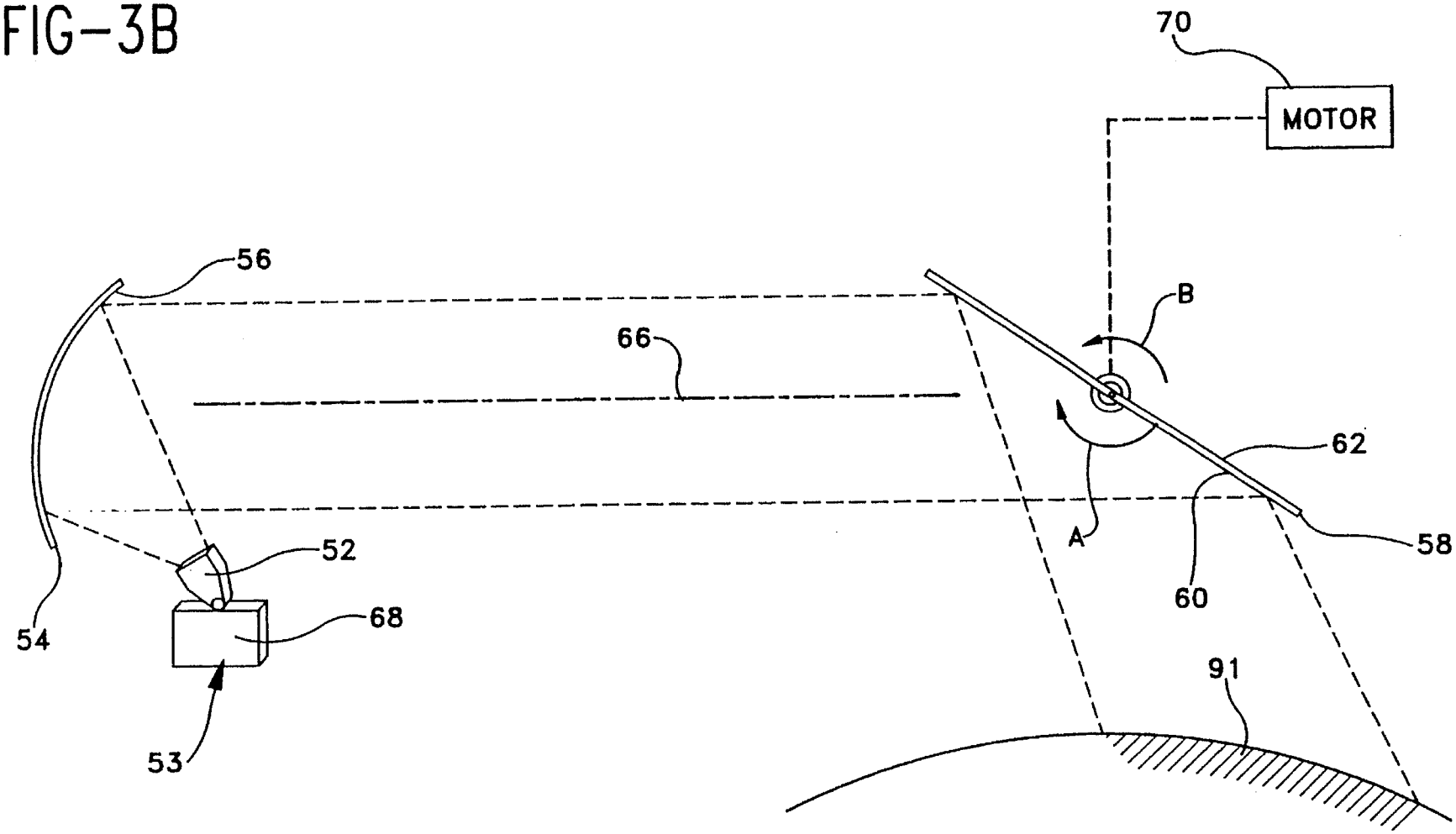
FIG. 3B is a side view of the embodiment shown in FIG. 3A where the antenna scanner beam footprint is shifted to the right.
Figure 3C:
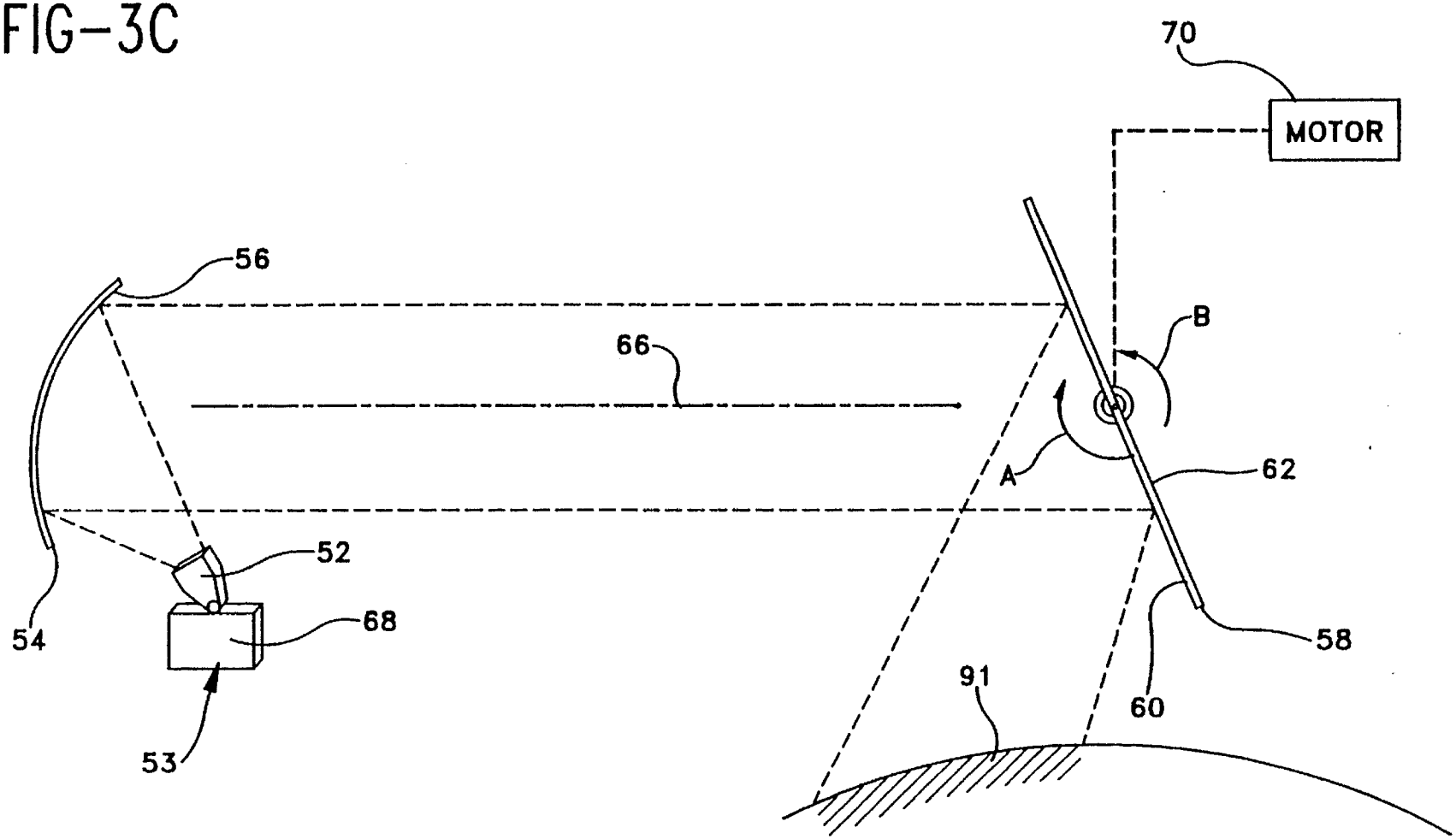
FIG. 3C is a side view of the embodiment shown in FIG. 2A where the antenna scanner beam footprint is shifted to the left.

FIGS. 3A, 3B, and 3C show three different antenna scanner beam footprints 91 projected by an antenna mirror scanner of the present invention carried by an aircraft 90 with a heading directed out the plane of the figure. Each of the scanner beam footprints is incident on a portion of the earth's surface 92 that is dependent on the rotation angle of planar reflector 58 about its rotational axis 64.

FIG. 3A shows planar reflector 58 at a rotational angle of 45° relative to a plane of planar reflector 58 that is parallel to a plane of the earth's surface 92. The antenna scanner beam projected with the planar reflector rotated at a 45° angle of rotation leaves a footprint 91 directly below the aircraft.

FIG. 3B shows the antenna scanner beam footprint 91 shifted to the port side of the aircraft 90 relative to the footprint of FIG. 3A. This is a result of a change in the rotation angle of planar reflector 58 to a rotation angle of less than 45°. FIG. 3C shows the antenna scanner beam footprint 91 shifted to the starboard side of aircraft 90 relative to the footprint of FIG. 3A. This is a result of a change in the rotation angle of the planar reflector 58 to a rotational angle of greater 45°. By changing the angle of rotation of planar reflector 58, the path of the scan is defined.

FIG. 4 shows another embodiment of an antenna mirror scanner 76 of the present invention wherein a non-rotating horn 78 is directly feeding electromagnetic energy in the form of a plane wave to a planar reflector 58. The horn 78 acts as a non-rotating direct-aperture antenna. A horn focusing lens such as focusing lens 5 depicted in FIG. 1 may also be used as the non-rotating direct-aperture antenna. This arrangement is provided because certain scanning conditions do not require the extra energy focusing ability of a paraboloid between a feed antenna, i.e., non-rotating horn 78, and a planar reflector 58. An axis of symmetry 80 of the horn 78 is positioned perpendicular to the rotational axis 64 (i.e., normal to the plane of the figure) of planar reflector 58.

Because the axis of symmetry 80 of the non-rotating horn 78 is positioned orthogonally to the planar reflector 58, the direction of propagation 66 of the plane wave radiated therefrom, i.e., antenna scanner beam, is orthogonal to the rotational axis of planar reflector 58. The polarization vectors of the antenna scanner beam generated therefore remain constant as the beam scans.

The exact method of providing a source of a plane wave to a reflective planar surface 60 or 62 of the planar reflector 58 is not critical to the invention.

Such a method can be determined by one skilled in the art. What is critical is that the direction of propagation 66 of the plane wave be always orthogonal to the rotational axis of the planar reflector. Although FIG. 3 shows the non-rotating horn 78 radiating energy (i.e., operating in a transmitter mode) towards planar reflector 58, the horn 78 can be utilized in a receiver mode as well, where the antenna mirror scanner 76 operates as a passive scanner.

The rotation of the planar reflector 58 in the above-described configurations is quite similar to that of the rotation of a paddle wheel. Because planar reflector 58 is formed with two back-to-back reflective planar surfaces, i.e., reflective planar surfaces 60 and 62, each complete rotation of planar reflector 58 about rotational axis 64 provides two complete scans of an antenna scanner beam formed thereby. To that end, both of reflective planar surfaces 60 and 62 may be polished to reflect incident energy.

The motor 70 shown in the figures may be a simple space-qualified motor (i.e., qualified to operate in low gravity) for driving the planar reflectors at a continuous angular velocity of, for example, 96 revolutions per minute. The back-to-back nature of the reflective planar surfaces 60 and 62 of planar reflector 58 allows for approximately 3 scans per second at 96 revolutions per minute. Two scans for each revolution of planar reflector 58 generates a zig-zag pattern of an antenna scanner beam incident at a surface to be scanned. Each 1° of angular rotation of planar reflector 58 about rotational axis 64 results in a 2° change in beam direction relative to a normal extending from a plane of a moving craft bearing the antenna mirror scanner 50 over a surface of the earth.

Any antenna means known to those skilled in the art may be used to direct the antenna scanner beam. For example, a non-rotating horn 78 as depicted in FIG. 4, a horn lens such as focusing horn lens 5 shown in FIG. 1 or a combination of non-rotating horn 52 and parabolic 54 as shown in FIGS. 2A and 2B may be used. The antenna scanner beam may be directed towards or received from a planar reflector as long as the antenna scanner beam has a propagational direction 66 that is orthogonal to the rotational axis 64 of planar reflector 58. The antenna scanner beam formed thereby will always display constant polarization vector orientation.

Figure 5:
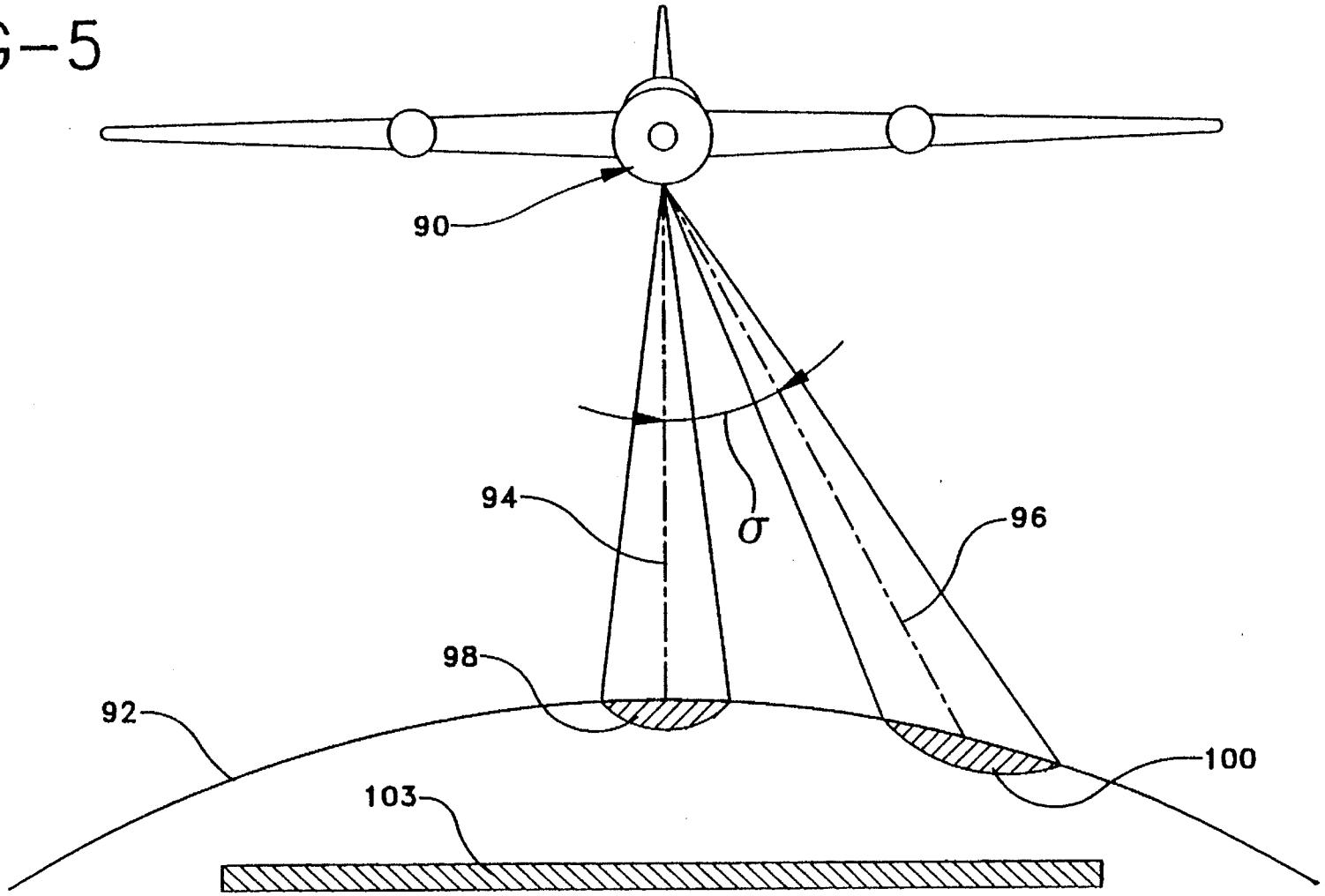
FIG. 5 is a frontal view of a moving aircraft from which is directed an antenna scanner beam generated by an antenna mirror scanner of the present invention.

FIG. 5 shows an aircraft 90 carrying an antenna mirror scanner 50 of the present invention. The heading of aircraft 50 is in a direction out of the plane of FIG. 4, and aligned with a rotational axis 64 of a planar reflector 58 included within antenna mirror scanner 50. A symmetrical axis 66 of paraboloid 54 is positioned orthogonally to the rotational axis 64. This positioning assures that electromagnetic energy radiated towards the paraboloid 54 from a non-rotating horn 52 is always formed in plane wave, the propagational direction of which is orthogonal to the rotational axis 64 of the planar reflector 58. An antenna scanner beam 94 is shown radiating from the aircraft 90 in a direction normal to a plane of the aircraft 90 that is parallel to the earth's surface 92.

While close to the aircraft 90, propagating antenna scanner beam 94 closely resembles a cylinder of focused electromagnetic energy. The cross-sectional area of the antenna scanner beam enlarges or spreads, however, with increasing distance from the aircraft. The angular displacement associated with the spread of the antenna scanner beam relative to the normal as the antenna scanner beam propagates is referred to as beamwidth. The beamwidth is equal to approximately 60 $\lambda/d$, where $\lambda$ is the wavelength of the radiated electromagnetic energy and d is the diameter of the beam at the planar reflector 58. The diameter of the beam can be approximated by the width of the planar reflector 58 because at many scan angles, the cross-sectional area of the antenna scanner beam is close in size to the surface area of the planar reflector 58.

An antenna scanner beam generated at a frequency of about 12 GHz has a wavelength λ equal to approximately 1 inch. A planar reflector 58 with a surface area of around 30 square feet has a diameter d which may be approximated to a five foot diameter. The resulting beamwidth for an antenna scanner beam generated within an antenna mirror scanner of the present invention maintaining those dimensions according to the above-described equation would be approximately 1°.

The significance of a 1° beamwidth resides in the resulting spotwidth of the footprint 98 provided by the antenna scanner beam 94 at the earth's surface 92. Spotwidth, S, is equal to Rθ, where R equals the distance to the earth, and θ is the beamwidth in radians. A scanner beam 94 displaying a 1° beamwidth at a distance R, 100 miles from the earth's surface 92, generates a footprint 98 with a spotwidth equal to approximately 1.745 miles in diameter. Rotating the planar reflector 58 about its rotational axis 64 directs the scanner beam in a scan on the earth's surface 92 approximately 1.745 miles deep, the line of sight length that is proportional to twice the angle of rotation of the planar reflector 58.

At angle θ, the antenna mirror scanner 50 of the present invention generates an antenna scanner beam 96 with a footprint 100 having a spotwidth 100 on the earth's surface 92 as shown in the figure. The angular rotation of a planar reflector producing a scanner beam at an angle θ relative to the normal is half of angle θ. For example, if the planar reflector is rotated ±15°, an antenna scanner beam is provided at an angle θ equal to ±30°. At 100 miles from the earth, the antenna scanner beam extends in a crosstrack 103 from port to starboard a distance on the surface of the earth approximately equal to twice R(Tan 2θ), or approximately 57 miles.

It is preferred in the paddle wheel concept of the present invention that a non-rotating fixed-aperture antenna be used to either transmit or receive the antenna scanner beam, just as is in a conventional planar reflector scanner. However, because the resolution of a formed antenna scanner beam is spatially determined, the surface area required for a tilted planar reflector used by the conventional mirror scanner differs from the surface area required for a planar reflector used in conjunction with the present invention.

The tilt angle of the planar reflector used in a conventional scanner is fixed defining a constant surface area requirement for its planar reflector. In contrast, the rotational angle of a planar reflector of the present invention constantly changes, normally requiring a larger surface area due to the commensurate changing cross-sectional area of the antenna scanner beam projected on each reflective planar surface of the planar reflector with rotation.

The surface area requirement of the planar reflector for use by the present invention is proportional to the variation of the rotational angle through which the planar reflector 58 is rotated. By limiting the angle of rotation of planar reflector 58, i.e., limiting rotation to less than 360 degrees, the surface area requirement for the planar reflector may be modified. For example, a scan may be limited by restricting the rotation of planar reflector 58 about its rotational axis to ±10 degrees in both directions. The result is an oscillation of the planar reflector 58 about its rotational axis 64 between 35 and 55 degrees relative to the normal. It follows that a footprint of the antenna scanner beam projected on each planar surface 60 or 62 at angles varying between 35 and 55 degrees require less surface area than, for example, footprints formed at rotational angles of 25 or 65 degrees.

The planar reflector may rotate continuously and still limit its planar reflector surface area requirement. This can be accomplished by limiting processing to only that antenna scanner beam information formed during a portion of each scan corresponding to a particular angular displacement. Because the planar reflector would not be required to support the size needs of an antenna beam directed with a full scan, the surface area requirement is decreased in proportion to the limited rotational angle. For example, rotation of the planar reflector could be limited between 35 and 55 degrees relative to the normal. Accordingly, the size of each reflective planar surface 60 or 62 need only be large enough to contain a complete cross-section of an antenna scanner beam incident thereon formed at the stated limited angles of rotation.

Although the antenna mirror scanner may be operated such that the planar reflector 58 oscillates about is rotational axis 64 within a particular angular span (defining a limited scan), rotating the planar reflector completely about its rotational axis offers several advantages. For example, some moving platforms, e.g., a space satellite, only requiring information derived from a limited scan may be affected such oscillatory operation. Mechanical perturbation results from the periodic starts and stops inherent in a partial rotation of the planar reflector about its axis which may have a deleterious effect on the satellite. It follows that a continuous rotation of the planar reflector 58 about its rotational axis 64 with processing limited to a particular angular span is a way to avoid the unwanted mechanical perturbation.

Another advantage of completely rotating the planar reflector 58 about its rotational axis 64, but limiting processing to particular portion of the antenna scanner beam formed by a limited angular span is the availability of the unused span for use in calibrating the antenna mirror scanner. That is, some portion of a scanner beam formed by the rotation of planar reflector 58, for example, below a 35 degree rotation angle and above a 55 degree rotation angle relative to the normal, may be directed at a load or the cold atmosphere above the moving craft, the temperature of which is known. By receiving an antenna scanner beam information from a load with a known temperature, the antenna mirror scanner may be calibrated. Further, such a method allows for a calibration to be performed with each complete revolution of the planar reflector 58 about its rotational axis 64.

Although illustrative embodiments of the present invention have been described herein with reference to the accompanying drawings, it is to be understood that the invention is not limited to those precise embodiments, and that random other changes and modifications may be effectuated therein by one skilled in the art without departing from the scope or spirit of the invention.

What is claimed is:

1. An antenna mirror scanner method for generating an antenna scanner beam displaying constant polarization characteristics from a platform having a direction of movement, the antenna mirror scanner method comprising the steps of:

aligning a reflector having at least one reflective surface with a non-rotating fixed-aperture antenna so that the direction of propagation of a plane wave of electromagnetic energy radiated at least one of towards and away from the antenna is orthogonal to a rotational axis of the reflector, the non-rotating fixed aperture antenna having a symmetrical axis;

substantially aligning the symmetrical axis of the non-rotating fixed aperture antenna in a perpendicular manner with the rotational axis of the reflector;

substantially aligning the rotational axis of the reflector in a parallel manner with the direction of movement of the platform; and rotating the reflector about the rotational axis so that the plane wave is directed as an antenna scanner beam incident upon the at least one reflective surface at least one of towards and away from the non-rotating fixed aperture antenna;

the combination of the steps of aligning the reflector with the non-rotating fixed aperture antenna, aligning the symmetrical axis of the non-rotating fixed aperture antenna with the rotational axis of the reflector, aligning the rotational axis of the reflector with the direction of movement of the platform and rotating the reflector providing an antenna scanner beam displaying constant polarization characteristics.

2. An antenna mirror scanner for generating and directing an antenna scanner beam displaying constant polarization characteristics, the antenna mirror scanner including a platform having a direction of movement, the antenna mirror scanner comprising:

a non-rotating direct-aperture antenna for at least one of transmitting and receiving electromagnetic energy in the form of an antenna scanner beam, the non-rotating direct-aperture antenna having asymmetrical axis;

a reflector having at least one reflective surface being coupled to the platform, an axis of rotation of the reflector being orthogonally aligned with a direction of propagation of the antenna scanner beam propagating at least one of towards and away from the at least one reflective surface, the axis of the reflector being substantially aligned in a perpendicular manner with the symmetrical axis of the non-rotating direct aperture antenna, the axis of rotation of reflector being substantially aligned in a parallel manner with the direction of the movement of the platform; and means for rotating the reflector about the axis of rotation to direct the antenna scanner beam incident upon the at least one reflective surface.

3. A method of generating and directing an antenna scanner beam displaying a constant polarization vector orientation from a platform having a direction of movement, the method comprising the steps of:

generating electromagnetic energy;

radiating the electromagnetic energy as a plane wave from a non-rotating fixed-aperture antenna towards a reflective planar surface of a planar reflector, an axis of rotation of the planar reflector being orthogonally aligned with an axis of symmetry of the non-rotating fixed-aperture antenna, the non-rotating fixed aperture antenna having symmetrical axis;

substantially aligning the symmetrical axis of the non-rotating fixed aperture antenna in a perpendicular manner with the rotational axis of the reflector;

substantially aligning the rotational axis of the reflector in a parallel manner with the direction of movement of the platform; and rotating the planar reflector about the axis of rotation to directively reflect the plane wave towards the reflective planar surface to form the antenna scanner beam;

the combination of the steps of generating electromagnetic energy, radiating the electromagnetic energy toward a reflective planer surface, aligning the symmetrical axis of the non-rotating fixed aperture antenna with the rotational axis of the reflector, aligning the rotational axis of the reflector with the direction of movement of the platform and rotating the planar reflector about the axis of rotation providing and directing an antenna scanner beam displaying a constant polarization vector.

4. An antenna mirror scanner for generating and directing an antenna scanner beam displaying constant polarization characteristics, the antenna mirror scanner including a platform having a direction of movement, the antenna mirror scanner comprising:

a non-rotating direct-aperture antenna for at least one of transmitting and receiving electromagnetic energy in the form of the antenna scanner beam;

a planar reflector having at least on reflective planar surface being coupled to the platform, an axis of rotation of the planar reflector being aligned orthogonally with an axis of symmetry of the non-rotating direct-aperture antenna, the axis of rotation of the planar reflector being substantially aligned in a parallel manner with the direction of movement of the platform; and means for rotating the planar reflector about the axis of rotation to direct the antenna scanner beam incident upon the at least one reflective planar surface at least one of towards and away from the antenna.

5. An antenna mirror scanner as defined by claim 4, wherein the non-rotating direct-aperture antenna includes a parabolic reflector having an axis of symmetry which is aligned orthogonally with the rotational axis of the planar reflector.

6. An antenna mirror scanner as defined by claim 4, wherein the planar reflector includes two reflective planar surfaces enabling two sweeps of an antenna scanner beam formed with each rotation of the planar reflector about the rotational axis thereof.

7. A remote earth radiometric sensor, the remote earth radiometric sensor including a platform having a direction of movement, the remote earth radiometric sensor comprising:

at least one planar reflector having at least one reflective planar surface, an axis of rotation of the at least one planar reflector being positioned orthogonal to an axis of symmetry of the at least one non-rotating direct-aperture receiving antenna, the axis of rotation of the at least one planar reflector being substantially aligned in a parallel manner with the direction of movement of the platform; and rotation means for rotating the at least one planar reflector to direct an antenna scanner beam displaying constant polarization characteristics resulting from electromagnetic energy radiated from the earth in the form of a plane wave and incident upon the at least one reflective planar surface to the at least one non-rotating direct aperture receiving antenna.

8. A remote earth radiometric sensor as defined by claim 7, wherein the at least one planar reflector includes two reflective planar surfaces such that each complete revolution of the planar reflector provides two complete earth scans with an antenna scanner beam.

9. A remote earth radiometric sensor as defined by claim 7, wherein the rotation of the planar reflector about its rotational axis directs an antenna scanner beam over a linear portion of the earth crosstrack substantially perpendicular to the direction of movement of the moving platform.

10. A remote earth radiometric sensor as defined by claim 7, wherein the at least one non-rotating direct-aperture receiving antenna includes a parabolic reflector having an axis of symmetry which is aligned orthogonally with the rotational axis of the planar reflector.

* * * * *